US007014261B2

(12) United States Patent
Haney

(10) Patent No.: US 7,014,261 B2
(45) **Date of Patent: *Mar. 21, 2006**

(54) PORTABLE FOLDING CHAIR

(75) Inventor: Thayne B. Haney, Harrisville, UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/030,427

(22) Filed: Jan. 6, 2005

(65) Prior Publication Data

US 2005/0121947 A1 Jun. 9, 2005

Related U.S. Application Data

(63) Continuation of application No. 10/390,312, filed on Mar. 17, 2003, now Pat. No. 6,871,906, which is a continuation of application No. 09/774,405, filed on Jan. 31, 2001, now Pat. No. 6,543,842.

(60) Provisional application No. 60/180,417, filed on Feb. 3, 2000.

(51) Int. Cl.
*A47C 4/00* (2006.01)

(52) U.S. Cl. ..... 297/55; 297/450.1; 297/440.19; 297/440.22; 297/452.65; 297/447.2; 297/447.4; 297/DIG. 2

(58) Field of Classification Search ..... 297/46, 297/55, 16.1, 440.1, 440.13, 440.14, 440.15, 297/440.19, 440.22, 452.65, 463.1, 447.1, 297/447.2, 447.4, 450.1, 451.1, 451.13, 57, 297/DIG. 2
See application file for complete search history.

(56) References Cited

U.S. PATENT DOCUMENTS 1,900,486 A 3/1933 Clarin
1,948,216 A 2/1934 Gillette
(Continued)

FOREIGN PATENT DOCUMENTS

FR 1258788 3/1961
(Continued)

OTHER PUBLICATIONS

Contour Seats, Options & Accessories, webpages, Feb. 2, 1999.
(Continued)

*Primary Examiner*—Laurie K. Cranmer
(74) *Attorney, Agent, or Firm*—Workman Nydegger

(57) ABSTRACT

A lightweight, inexpensive folding chair may have a seat with an interference fit support bracket may be provided. The seat may have a lightweight seat member constructed of a lightweight material, such as a blow-molded plastic, that is generally supported by two such support brackets. The support brackets may be affixed to the lightweight seat member by sliding the lightweight seat member into interference engagement with the support brackets. Thus, the lightweight seat member is supported against bending when the chair is in use, in a way that does not concentrate stresses in the lightweight seat member to cause deformation and failure. The support brackets may have an enclosing shape so that the lightweight seat member is unable to move laterally or transversely out of engagement with the support brackets. The support brackets may thus have lips extending into the lightweight seat member to provide the enclosing shape. The support brackets may also have an arcuate shape to strengthen the support brackets against bending.

20 Claims, 3 Drawing Sheets

U.S. PATENT DOCUMENTS

| | | | |
|---|---|---|---|
| D107,545 | S | 12/1937 | O'Connor |
| D118,185 | S | 12/1939 | Bond |
| 2,364,093 | A | 12/1944 | O'Connor |
| 2,390,878 | A | 12/1945 | Greitzer |
| 2,564,924 | A | 8/1951 | Patton |
| 2,620,019 | A | 12/1952 | Merrill et al. |
| 2,694,442 | A | 11/1954 | Nordmark |
| 2,737,231 | A | 3/1956 | O'Neill |
| 2,865,437 | A | 12/1958 | Shwayder |
| 3,094,357 | A | 6/1963 | Shwayder |
| 3,171,691 | A | 3/1965 | Buehrig |
| 3,431,011 | A | 3/1969 | Poppe et al. |
| 3,431,022 | A | 3/1969 | Poppe et al. |
| 3,466,084 | A | 9/1969 | Moore et al. |
| 3,521,349 | A | 7/1970 | Gehring |
| 3,669,496 | A | 6/1972 | Chisholm |
| 3,695,687 | A | 10/1972 | Uyeda |
| 3,726,330 | A | 4/1973 | Adler |
| 3,792,353 | A | 2/1974 | Loika, Jr. |
| 3,822,084 | A | 7/1974 | Brezosky |
| 3,857,604 | A | 12/1974 | Scott |
| 3,907,363 | A | 9/1975 | Baker et al. |
| 4,059,199 | A | 11/1977 | Quaney |
| 4,076,787 | A | 2/1978 | Ervin et al. |
| 4,092,745 | A | 6/1978 | Oropallo |
| 4,140,236 | A | 2/1979 | Uhlig et al. |
| 4,157,674 | A | 6/1979 | Carlson et al. |
| 4,189,876 | A | 2/1980 | Crossman et al. |
| 4,215,089 | A | 7/1980 | Uhlig et al. |
| 4,223,585 | A | 9/1980 | Barth et al. |
| 4,281,773 | A | 8/1981 | Mengeu |
| 4,415,201 | A | 11/1983 | Wang |
| D274,865 | S | 7/1984 | Murry |
| D274,866 | S | 7/1984 | Murry |
| D274,869 | S | 7/1984 | Aronowitz et al. |
| D276,956 | S | 1/1985 | Aronowitz et al. |
| D277,144 | S | 1/1985 | Murry |
| D277,443 | S | 2/1985 | Murry |
| D279,152 | S | 6/1985 | Murry |
| D279,154 | S | 6/1985 | Aronowitz et al. |
| D279,155 | S | 6/1985 | Aronowitz et al. |
| D279,246 | S | 6/1985 | Murry |
| D279,247 | S | 6/1985 | Murry |
| 4,586,738 | A | 5/1986 | Butler et al. |
| 4,620,330 | A | 11/1986 | Izzi, Sr. |
| 4,671,570 | A | 6/1987 | Hockenberry et al. |
| 4,727,816 | A | 3/1988 | Virtue |
| 4,732,726 | A | 3/1988 | Grannen, III |
| 4,768,825 | A | 9/1988 | Quinlan, Jr. |
| 4,768,833 | A | 9/1988 | Virtue |
| 4,826,265 | A | 5/1989 | Hockenberry |
| 4,841,877 | A | 6/1989 | Virtue |
| 4,854,638 | A | 8/1989 | Marcus et al. |
| 4,860,421 | A | 8/1989 | Breda et al. |
| 4,861,100 | A | 8/1989 | Baccaro |
| 4,898,421 | A | 2/1990 | Brunn |
| 4,951,576 | A | 8/1990 | Cobos et al. |
| 4,987,714 | A | 1/1991 | Lemke |
| D314,871 | S | 2/1991 | Goetz |
| 4,995,323 | A | 2/1991 | Kellems et al. |
| 5,078,562 | A | 1/1992 | DeHaitre |
| 5,100,204 | A | 3/1992 | Makihara et al. |
| 5,133,630 | A | 7/1992 | Hughes |
| 5,167,436 | A | 12/1992 | Wu |
| 5,222,850 | A | 6/1993 | Medal |
| 5,244,291 | A | 9/1993 | Confer |
| 5,271,650 | A | 12/1993 | Fukuhara et al. |
| 5,288,453 | A | 2/1994 | Rutenbeck et al. |
| 5,375,914 | A | 12/1994 | Donnelly |
| 5,413,833 | A | 5/1995 | Hernandez et al. |
| 5,443,020 | A | 8/1995 | Price |
| 5,498,045 | A | 3/1996 | Morgan et al. |
| 5,507,563 | A * | 4/1996 | Arthur, Jr. ..... 297/440.23 |
| 5,538,680 | A | 7/1996 | Enders |
| 5,542,743 | A | 8/1996 | Olson et al. |
| 5,582,460 | A | 12/1996 | Schultz |
| 5,593,262 | A | 1/1997 | Gedeon et al. |
| 5,641,035 | A | 6/1997 | Pettit |
| 5,671,686 | A | 9/1997 | Hurley et al. |
| 5,679,304 | A | 10/1997 | Watanabe et al. |
| 5,681,078 | A | 10/1997 | Chen |
| 5,694,865 | A | 12/1997 | Raab |
| 5,697,744 | A | 12/1997 | Medal |
| 5,699,944 | A | 12/1997 | Duran |
| 5,704,750 | A | 1/1998 | Bartos et al. |
| 5,711,576 | A | 1/1998 | Olson et al. |
| 5,718,474 | A | 2/1998 | Kojima et al. |
| 5,730,489 | A | 3/1998 | Eberle et al. |
| 5,735,656 | A | 4/1998 | Marvell et al. |
| 5,749,628 | A | 5/1998 | Synder et al. |
| 5,769,256 | A | 6/1998 | Medal |
| 5,848,718 | A | 12/1998 | Colwell |
| 5,855,409 | A | 1/1999 | Tseng |
| 5,879,115 | A | 3/1999 | Medal |
| 5,951,110 | A | 9/1999 | Conner et al. |
| 5,983,807 | A | 11/1999 | Tarnay et al. |
| D422,805 | S | 4/2000 | Smith |
| 6,068,901 | A | 5/2000 | Medal |
| 6,095,225 | A | 8/2000 | Miller |
| 6,102,156 | A | 8/2000 | Lipniarski |
| D432,805 | S | 10/2000 | Smith |
| 6,126,355 | A | 10/2000 | Clover, Jr. |
| 6,131,992 | A | 10/2000 | Chang |
| D435,977 | S | 1/2001 | Ambasz |
| D436,457 | S | 1/2001 | Ambasz |
| 6,171,041 | B1 | 1/2001 | Bazinski et al. |
| 6,193,307 | B1 | 2/2001 | Lin |
| D443,429 | S | 6/2001 | Mower et al. |
| 6,250,524 | B1 | 6/2001 | Maruyama |
| 6,394,541 | B1 | 5/2002 | Wegner |
| 6,543,842 | B1 | 4/2003 | Haney |
| 6,871,906 | B1 | 3/2005 | Haney |

FOREIGN PATENT DOCUMENTS

| | | |
|---|---|---|
| FR | 2312217 | 12/1976 |
| FR | 2505789 | 11/1982 |
| GB | 321989 | 11/1929 |
| GB | 2317332 | 3/1998 |
| JP | 06269331 | 9/1994 |
| JP | 8-322672 | 12/1996 |
| JP | 08322671 | 12/1996 |
| JP | 08322672 | 12/1996 |

OTHER PUBLICATIONS

Digital photographs of stadium seats, dates unknown.

Defendant FDL, Inc.'s Answer to Plaintiffs' Complaint and FDL Inc.'s Counterclaim, Apr. 19, 2004, 7 pages.

Defendant FDL, Inc.'s Amended Answer to Plaintiffs' Complaint and FDL Inc.'s Counterclaim, Apr. 20, 2004, 36 pages.

Defendant's Preliminary Response to Plaintiff's Motion for Preliminary Injunction and Motion to Defer Briefing and Permit Expedited Discovery, Mar. 18, 2004, 13 pages.

Appendix of Exhibits A—J in Support of Defendant GSC Technology Corporation's Preliminary Opposition to Lifetime's Motion for Preliminary Injunction, 88 pages.

Defendant's Answer to Plaintiff's Complaint and Counterclaims, Apr. 5, 2004, 39 pages.

* cited by examiner

PORTABLE FOLDING CHAIR

RELATED APPLICATIONS

This application is a continuation of U.S. patent application Ser. No. 10/390,312, entitled PORTABLE FOLDING CHAIR, filed on Mar. 17, 2003, now U.S. Pat. No. 6,871,906, which is a continuation of U.S. patent application Ser. No. 09/774,405, entitled INTERFERENCE FIT SUPPORT BRACKET FOR A PORTABLE FOLDING CHAIR, filed on Jan. 31, 2001, now U.S. Pat. No. 6,543,842, which claims priority to and the benefit of U.S. provisional patent application Ser. No. 60/180,417, entitled FOLDING CHAIR WITH DOUBLE-WALLED SEAT, filed Feb. 3, 2000, each of which are incorporated by reference in their entireties.

BACKGROUND OF THE INVENTION

1. The Field of the Invention

The present invention relates to portable furniture and, more particularly, to novel systems and methods for providing comfortable, compact, inexpensive, and lightweight seating for easy transportation and storage.

2. The Relevant Technology

Throughout history, people have sought more comfortable seating arrangements. Chairs, stools, and the like allow people to relieve stress on the legs and feet, while remaining alert and performing tasks that do not require a great deal of motion. In the twentieth century, folding chairs have made it possible for people to keep a space clear when necessary, and to erect suitable seating for gatherings or special events. However, current folding chairs possess a number of drawbacks.

For example, folding chairs are often somewhat heavy. The chair must reliably support the weight of even a fairly large person. The bending stress on any member is proportional to the length of the member multiplied by the force acting upon it. Therefore, the length of the seat effectively multiplies the forces tending to bend or break the seat. Typically, seats for folding chairs have been made from stronger (and heavier) materials, such as steel, to overcome the effect of these bending stresses. The resulting chairs are heavier and therefore cost more to ship, and require more effort to move, fold, and unfold.

Thus, it is desirable to use lightweight materials such as plastics to reduce the weight of folding chairs. However, many known folding chairs, especially those that incorporate lightweight materials, do not stand up to repetitive use. Groups such as the Business and Institutional Furniture Manufacturers' Association (B.I.F.M.A.) have set up standards for portable furniture. Such standards typically require that portable chairs be designed to receive a given weight loading to simulate use for a specified number of cycles, often on the order of 100,000. Many known folding chairs bend or break after only a few thousand cycles, and therefore can be expected to have a relatively short useful life.

Certain known chairs use metal to reinforce lightweight materials. The seat may, for example, be supported by a frame encircling the seat or by metal rods threaded through the lightweight material. In addition to increasing the weight of the folding chair, such reinforcing measures add to manufacturing time because the supporting structure must be properly aligned with the seat, and possibly with the legs as well.

In general, many known folding chairs are somewhat expensive to produce because the manner in which they are assembled requires the use of a great deal of manual labor.

The legs must often be properly aligned with the seat so that mechanical fasteners can be attached to the legs and the seat. If metal supporting parts are to be threaded through the lightweight seat member to connect the legs, the lightweight seat member may have to be aligned with each leg assembly so that the threading operation can be carried out. Often, the various fasteners involved must be installed at locations that are not easily accessible for machinery. Thus, the fasteners must often be installed by hand.

Accordingly, a need exists for a portable, folding chair that is lightweight and comfortable, and yet folds to a thin, stackable configuration. Such a chair must safely support the weight of a fairly heavy person. In addition, the chair should be inexpensive to produce in large quantities with a minimum of parts and assembly.

BRIEF SUMMARY OF THE INVENTION

The apparatus of the present invention has been developed in response to the present state of the art, and in particular, in response to the problems and needs in the art that have not yet been fully solved by currently available folding chairs. Thus, it is an overall objective of the present invention to provide an inexpensive, lightweight, comfortable, chair capable of folding to fit within a small volume.

To achieve the foregoing objects, and in accordance with the invention as embodied and broadly described herein in the preferred embodiment, a folding chair with an interference fit support bracket is provided. According to selected embodiments, the folding chair may comprise a pair of symmetrical leg assemblies, each of which includes a front leg and a rear leg. Each of the legs may have a lower end in contact with the ground or floor, and an upper end extending upward from the lower end. A seat may be suspended between the leg assemblies. The upper end of the front legs may also be extended to retain a backrest between the leg assemblies.

The seat may be pivotally attached to the front leg and the rear leg of each of the leg assemblies. Each of the leg assemblies may also have a strut pivotally attached to the front leg and the rear leg, so that the strut, front leg, rear leg, and seat form a four-bar, four-pivot linkage. The chair may thus be folded by rotating the seat with respect to the front legs, so that the seat and rear legs fold into a position substantially parallel to the front legs.

The seat may comprise a lightweight seat member constructed of a lightweight material, such as plastic, and a pair of support brackets constructed of a stronger material such as a metal. The lightweight seat member may be hollow and may be formed through a suitable process such as injection or blow molding. Each support bracket may be elongated in the longitudinal direction, with a generally enclosing cross-sectional shape designed to grip the lightweight seat member to restrict relative motion of the support bracket and lightweight seat member perpendicular to the length of the support bracket. The lightweight seat member may, in turn, have engaging features such as a lateral ridge and a slot to receive each bracket. The lightweight seat member may be generally configured to make contact with each of the support brackets in several places so that lateral and transverse relative motion of the lightweight seat member and support brackets can be fully prevented.

Each support bracket preferably grips the seat with a retention force sufficient to ensure that the support bracket cannot slide relative to the lightweight seat member in the longitudinal direction during normal use of the folding chair. To install the support brackets on the lightweight seat member, each support bracket is preferably aligned with the corresponding engaging features of the lightweight seat member and pressed with an installation force similar in magnitude to the retention force.

Each support bracket may also have a tab designed to be bent into engagement with a corresponding tab engagement slot formed in the lightweight seat member after the support bracket has been properly positioned with respect to the lightweight seat member. The tabs operate in conjunction with the retention force of the support bracket to ensure that the brackets cannot slide longitudinally off of the seat.

The folding chair maybe easily assembled by, first, assembling the leg assemblies, and then affixing a support bracket to each leg assembly through the use of mechanical fasteners such as rivets, bolts, shafts with locking pins, or the like. The backrest may be affixed to the legs by any suitable fastening mechanism. The leg assemblies may then be aligned relative to each other to receive the lightweight seat member, and the lightweight seat member may be pressed into engagement with the brackets.

Thus, the folding chair of the present invention provides a number of unique advantages over the prior art. For example, a minimum of metal material may be used to affix the lightweight seat member to the leg assemblies. No metal supports, such as rods or backing plates, need be affixed to or threaded through the lightweight seat member. Additionally, fixation is accomplished without forming holes in the lightweight seat member; thus, there are no stress concentrations to weaken the seat under repeated use. The folding chair can be easily assembled with actions that can generally be performed rapidly by machine.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the apparatus, system, and method of the present invention, as represented in FIGS. 1 through 4, is not intended to limit the scope of the invention, as claimed, but is merely representative of presently preferred embodiments of the invention.

Figure 1:
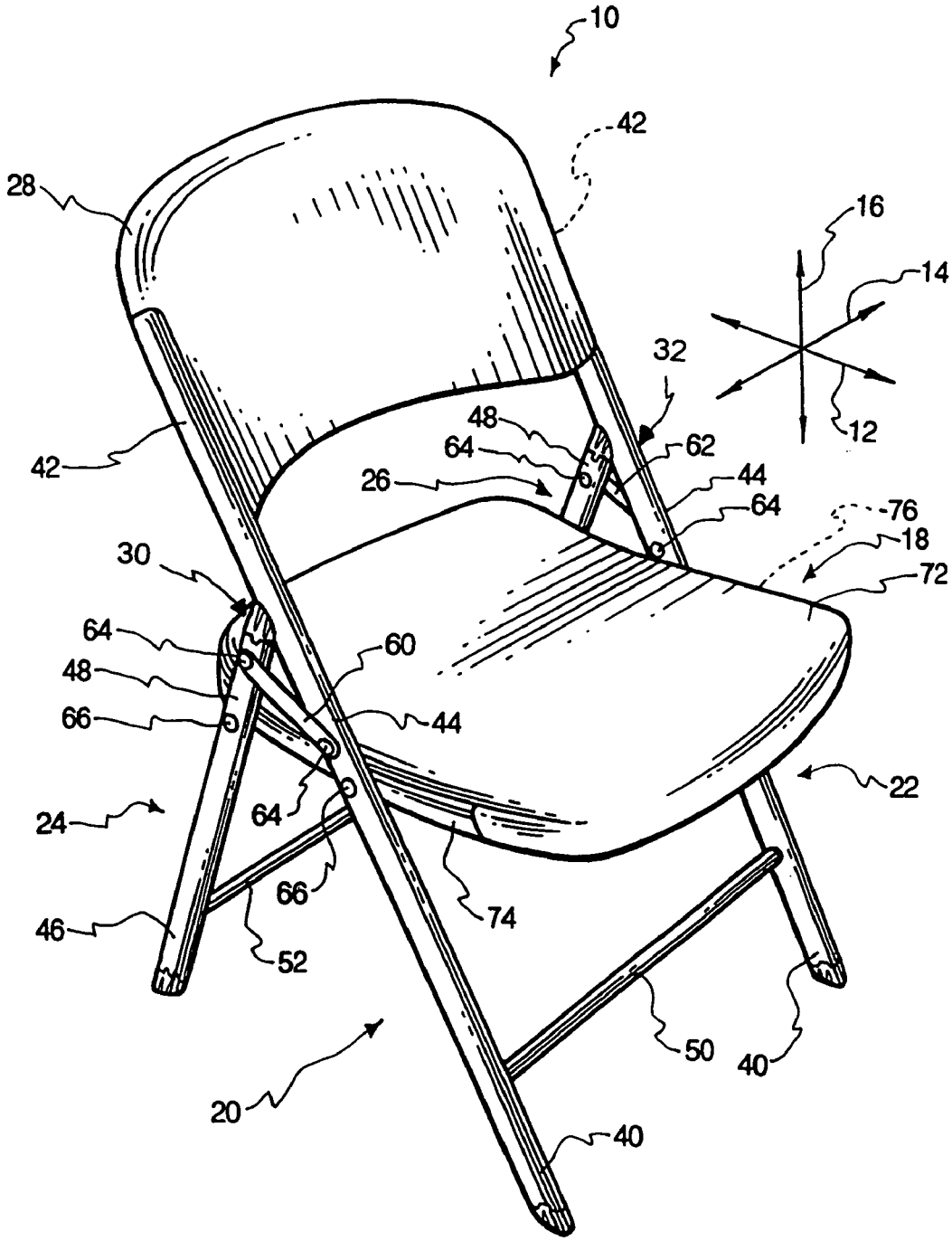
FIG. 1 is a perspective view of one embodiment of a folding chair with a lightweight seat member supported by interference fit support brackets in accordance with the invention.

Referring to FIG. 1, one embodiment of a folding chair 10 according to the invention is shown. The folding chair 10 has a longitudinal direction 12, a lateral direction 14, and a transverse direction 16. The folding chair 10 has a seat 18 designed to comfortably support the weight of a user. The seat 18 may be contoured as shown, with a recessed portion toward the middle to distribute a user's weight evenly along the seat, thereby enhancing the user's comfort. Preferably, the folding chair 10 has an unfolded configuration, in which the seat 18 is horizontally disposed at a height suitable for sitting, and a folded configuration in which the folding chair 10 is more compact and stackable.

The seat 18 may be supported by a first front leg 20, a second front leg 22, a first rear leg 24, and a second rear leg 26. Preferably, the legs 20, 22, 24, 26 are hollow so that higher buckling resistance can be obtained without increasing the weight of the legs 20, 22, 24, 26. The cross-sectional shape of the legs 20, 22, 24, 26 may be further modified to enhance buckling resistance along the axis of greatest bending stress. For example, the legs 20, 22, 24, 26 may have a generally elliptical cross-section with the major (longer) axis oriented near the longitudinal direction 12. Thus, the legs 20, 22, 24, 26 can be fortified against bending moments occurring around the lateral direction 14, as would be applied by a user sitting in the folding chair 10.

The legs 20, 22, 24, 26 may be constructed of a relatively strong, stiff material such as aluminum or steel. The legs 20, 22, 24, 26 may be surface hardened and made more resistant against damaging environmental effects such as rust and ultraviolet radiation through a method such as powder coating, in which a resin or plastic powder is applied to the surface of the metal and then heated to harden the surface.

The front legs 20, 22 may also be upwardly extended to support a backrest 28 at a height comfortable for a user. The backrest 28 may be contoured to comfortably fit the back of a user, and may be constructed of a lightweight material such as plastic with a hollow configuration to provide a larger sectional modulus to enhance bending resistance. The backrest 28 may be manufactured through a comparatively simple production process such as blow molding, injection molding, or the like.

As depicted in FIG. 1, the first front leg 20 and the first rear leg 24 are connected together to form a linkage. The first front leg 20 and the first rear leg 24 may thus be collectively referred to as a first leg assembly 30. Similarly, the second front leg 22 and the second rear leg 26, together, form parallel linkage that may be termed a second leg assembly 32. In FIG. 1, the leg assemblies 30, 32 are shown on opposite lateral sides of the folding chair 10. However, a folding chair according to the invention could, for example, have symmetrical leg assemblies disposed at the front and rear of the chair.

The front legs 20, 22 may each have a lower end 40 in contact with flooring, pavement, or some other supporting surface, and an upper end 42 extending above the seat 18 to receive the backrest 28. Each of the front legs 20, 22 may also have an intermediate portion 44 disposed generally between the lower end 40 and the upper end 42, at the approximate elevation of the seat 18. Each of the rear legs 24, 26 may have a lower end 46 in contact with a supporting surface and an upper end 48 at the approximate elevation of the seat 18.

A front strut 50 may connect the first front leg 20 with the second front leg 22, and a rear strut 52 may connect the first rear leg 24 with the second rear leg 26. The front and rear struts 50 and 52 provide alignment and mutual support between the first and second leg assemblies 30, 32. The legs 20, 22, 24, 26 and the struts 50, 52 are preferably constructed of a stiff, strong material such as steel, aluminum, or a composite.

The first front leg 20 may be connected to the first rear leg 24 by a first link 60 pivotally attached to the first front leg 20 and to the first rear leg 24. Similarly, the second front leg 22 and the second rear leg 26 may be connected by a second link 62. Thus, the first link 60 may be part of the first leg assembly 30, and the second link 62 may be part of the second leg assembly 32. The legs 20, 22, 24, 26 may be attached to the links 60, 62 by fasteners 64 and to the seat 18 by fasteners 66, each of which permits relative pivotal motion. Thus, each of the first and second leg assemblies 30, 32 forms a four-bar, four-pivot linkage when connected to the seat 18 to permit the rear legs 24, 26 and the seat 18 to fold into a configuration substantially parallel to the front legs 20, 22 and the backrest 28. Thus, the folding chair 10 may be folded and stored in are relatively compact fashion.

Figure 2:
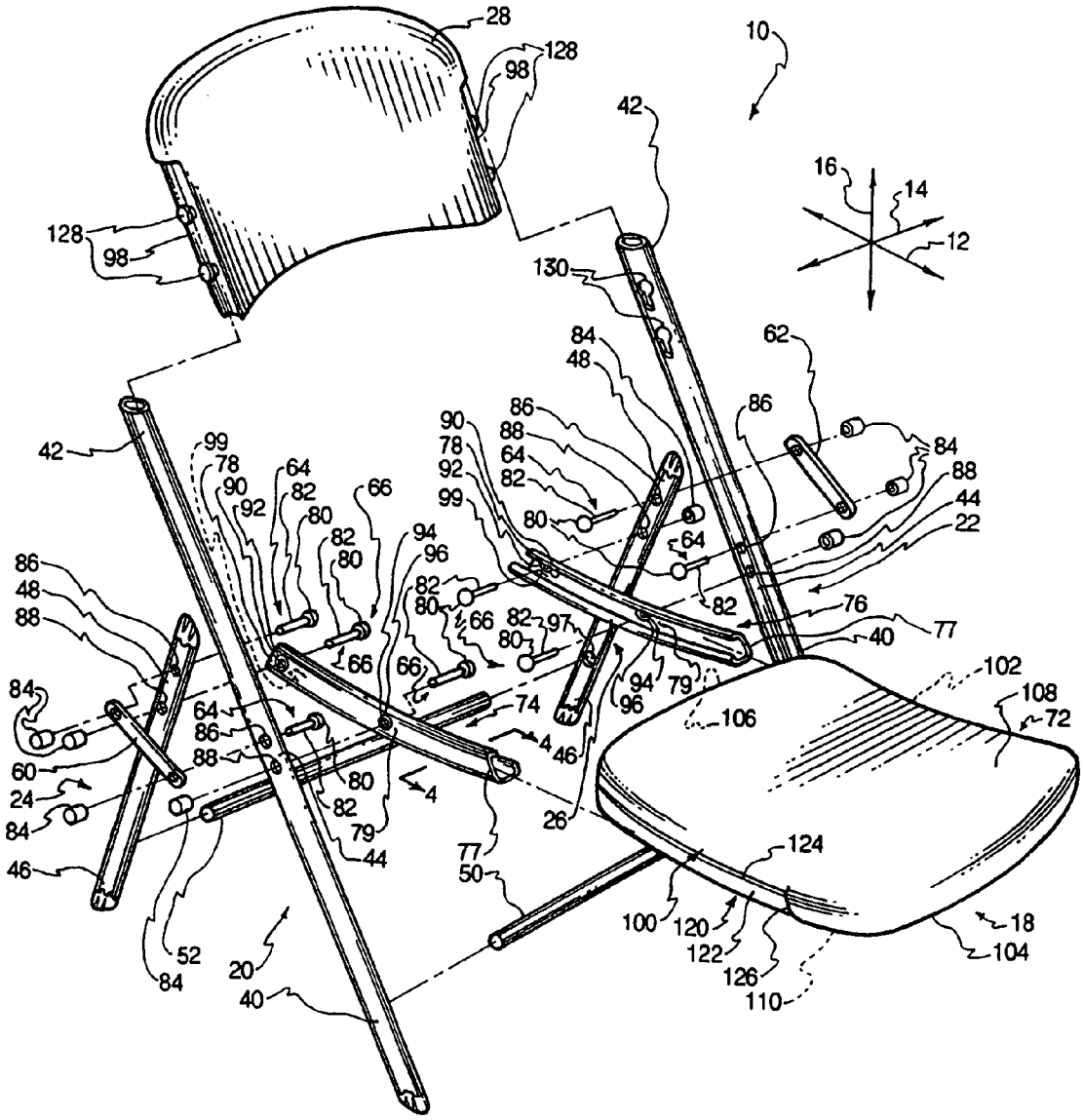
FIG. 2 is an exploded, perspective view depicting one possible mode of the assembly of the folding chair of claim 1.

Referring to FIG. 2, an exploded view of the folding chair 10 of FIG. 1 is depicted, along with lines of assembly depicting one suitable way to assemble the various parts of the folding chair 10. The seat 18 may include a lightweight seat member 72, a first support bracket 74, and a second support bracket 76. The lightweight seat member 72, like the backrest 28, is preferably constructed of a lightweight, somewhat flexible material such as a plastic.

Many manufacturing methods may be used to produce the lightweight seat member 72. For example, top and bottom portions of the lightweight seat member 72 may be constructed separately, through stamping, injection molding, or other simple processes, and then attached together. The top and bottom portions may be attached by molding fasteners into the parts, using separate fasteners, or joining the parts using a heat-based technique such as welding. Other processes, such as tumble molding, roller molding, and blow molding may also be utilized to create the seat 12 as a single unitary piece. Blow molding is presently preferred.

The novel construction of the folding chair 10 is especially well-adapted for use with a lightweight seat member 72 constructed of such a lightweight material because the lightweight seat member 72 can be attached to the folding chair 10 in a way that does not subject the lightweight seat member 72 to highly-localized stresses. Plastics generally have a much lower yield point (maximum stress before permanent deformation occurs) than metals. Additionally, plastics tend to experience "creep," or permanent deformation over prolonged loading, at comparatively low stresses. Consequently, it is important to ensure that no part of the lightweight seat member will be subjected to high or prolonged stresses.

A number of features found in known chair seats tend to concentrate stresses at parts of the seat that could later become failure points in a seat constructed of weaker, lightweight material. For example, many chairs have fasteners that must be inserted through holes formed in the lightweight seat member. Any hole in a load-bearing member has a smaller cross-section than adjacent regions. Since stress is defined as force (tensile, compressive, or shear) divided by the area of material across which the force acts, the smaller area surrounding the hole is subjected to increased stresses as a result of the hole. Thus, holes, narrow regions, shelves, and the like are referred to in the art as "stress concentrations" or "stress risers."

The effect of such stress concentrations is multiplied by the nature of the loading applied to the lightweight seat member. A typical user will not simply sit still in a chair for a lengthy period of time; rather, most users will move considerably and shift their weight from one portion of the chair to another. Thus, the lightweight seat member is subjected to "fatigue" loading, or stress that increases, decreases, or even changes direction (from tensile to compressive or from compressive to tensile) many times during the life of the chair. Fatigue loading conditions accelerate the deformation and eventual failure of materials, especially those with a comparatively high degree of ductility, such as plastics.

In the case of a fastener threaded through a plastic hole, the result is that the hole will be gradually widened by pressure against the fastener over time, so that more and more play, or "slop," is present in the folding chair. Finally, the hole may fail to retain the fastener altogether, and the chair may collapse as a result. Other forms of attachment may similarly concentrate stresses that tend to cause accelerated failure in a plastic seat member.

The support brackets 74, 76 of the present invention represent a significant improvement over the prior art because they are attached to the lightweight seat member 72 in such a way that stresses are relatively evenly spread over the lightweight seat member 72 when the folding chair 10 is in use. According to certain embodiments, the support brackets 74, 76 provide such an even distribution of stresses through an interference fit engagement with lightweight seat member 72 that will be described in further detail subsequently.

Each of the support brackets 74, 76 may have a front end 77, a rear end 78, and an intermediate portion 79. The fasteners 64, 66 used to attach the leg assemblies 30, 32 to the struts 60, 62 and the support brackets 74, 76 may have a wide variety of configurations including screws, bolts, nuts, rivets, clips, clamps, shafts with locking pins, or the like. As depicted in FIG. 2, each of the fasteners 64, 66 comprises a rivet. Generally, each of the rivets 64, 66 may have a button 80 affixed to a shank 82 sized somewhat narrower than the button 80. Each of the rivets 64, 66 may also have a cap 84 configured to fit onto the shank 82 and to be compressed for permanent attachment to the shank 82 by a method such as crimping.

Each of the legs 20 22, 24, 26 may have a hole 86 sized to receive a shank 82 of a rivet 64 for pivotal attachment to one of the links 60, 62. Similarly, each of the legs 20, 22, 24, 26 may have a hole 88 sized to receive a shank 82 of a rivet 66 for pivotal attachment to one of the support brackets 74, 76. Each of the support brackets 74, 76 may have a rear hole 90 surrounded by a rear indentation 92 and a front hole 94 surrounded by a front indentation 96. The indentations 92, 96 are preferably each shaped to contain a button 80 of a rivet 66. Thus, the buttons 80 can be retained on the inside of the support brackets 74, 76 without protruding inward to interfere with the lightweight seat member 72.

Preferably, the shanks 82 of the rivets 64, 66 fit with clearance through the holes 86, 88, 90, 94 to permit free relative rotation. Additionally, the buttons 80 and caps 84 of the rivets 64, 66 should be sized too large to fit through the holes 90, 94 and 86, 88, respectively, so that the rivets 64, 66 are unable to slip out of the holes 86, 88. The legs 20, 22, 24, 26 may each have an alcove 97 facing inward and located toward the first end 40, 46 into which the struts 50, 52 can be inserted. If desired, the struts 50, 52 may be welded, crimped, or otherwise affixed in place within the alcoves 97 to fix the displacement of the leg assemblies 30, 32 with respect to each other. The backrest 28 may also bridge the gap between the first and second leg assemblies 30, 32 upper ends 42 of which may be attached to mating surfaces 98 of the backrest 28.

Each of the support brackets 74, 76 may have a tab 99 configured to lock the lightweight seat member 72 into place once installed within the support brackets 74, 76. The tab 99 preferably comprises a rectangular portion of each of the support brackets 74, 76, three sides of which have been cut through so that the tab 99 can be lifted by folding the tab 99 along the remaining side of the rectangle. The tabs 99 may be preformed in a bent position, and may flex upon contact with the lightweight seat member 72 and snap into place within grooves of the lightweight seat member 72, which will be depicted subsequently. The tabs 99 may alternatively be formed in a straight position and bent into engagement after installation on the lightweight seat member 72.

The support brackets 74, 76 are preferably made of a comparatively stiff, strong metal such as aluminum or steel. The support brackets 74, 76 may also be surface treated by a method such as powder coating, like the legs 20, 22, 24, 26. Pre-flexing of the tabs 99 helps to prevent cracking of the tabs 99 when they are bent during assembly.

The lightweight seat member 72 may generally have a first side 100 disposed near the first leg assembly 30, and a second side 102 disposed near the second leg assembly 32. Additionally, the lightweight seat member 72 may have a front surface 104, a rear surface 106, a top surface 108, and a bottom surface 110. A lateral ridge 120 maybe formed on each of the first and second sides 100, 102. Each lateral ridge 120 may comprise a longitudinally elongated bulge with a lateral engagement surface 122, an engagement groove 124, and an abutment 126. The lateral engagement surface 122 is preferably oriented substantially perpendicular to the lateral direction 14. Preferably, each of the lateral ridges 120 has a substantially uniform cross-sectional shape, as viewed along the longitudinal direction 12, so that the lateral ridges 120 engage the support brackets 74, 76 uniformly along their length.

The engagement groove 124 may take the form of a trough extending downward and inward, running along the top of each lateral ridge 120. Each of the abutments 126 may simply consist of a rearward-facing portion material jutting outward from each lateral ridge 120. The abutments 126 serve to limit motion of the support brackets 74, 76 over the lateral ridges 120 to ensure that the support brackets 74, 76 do not slide too far with respect to the lightweight seat member 72.

The backrest 28 may be attached to the upper ends 42 of the front legs 20, 22, for example, through the use of studs 128 affixed to the mating surfaces 98 of the backrest 28. The studs 128 may be generally mushroom-shaped, with an enlarged head atop a narrower stem. Corresponding keyholes 130 may be formed in the upper ends 42 of the front legs 20, 22 to receive the studs 128. Each of the keyholes 130 may generally have a larger opening into which a head of a stud 128 can pass with clearance, and a slot configured to receive the stem of the stud 128 when the backrest 28 is pressed downward with respect to the front legs 20, 22. Other fastening techniques, such as thermal, radio frequency, or frictional welding, chemical or adhesive bonding, or the like may be utilized to ensure that the studs 128 remain firmly installed within the keyholes 130.

Figure 3:
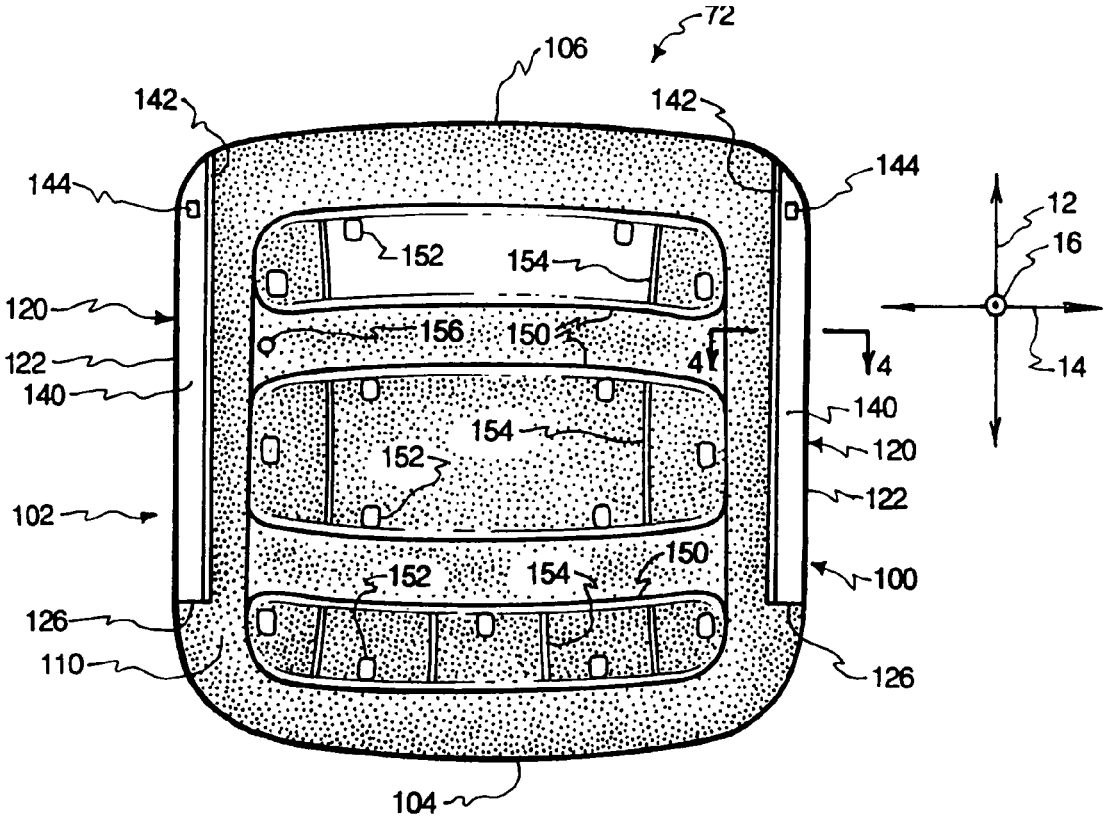
FIG. 3, is a bottom elevation view of the underside of the lightweight seat member of FIG. 1.

Referring to FIG. 3, the bottom surface 110 of the lightweight seat member 72 is depicted. Each of the lateral ridges 120 may have a transverse engagement surface 140 facing generally downward. Slots 142 may run parallel to the lateral ridges 120 to provide tighter engagement of the support brackets 74, 76. The slots 142 may simply take the form of rectangular recesses extending longitudinally along the bottom surface 110. A tab engagement slot 144, in the form of a roughly rectangular indentation, may be formed in each of the transverse engagement surfaces 140 to receive the tabs 99.

The bottom surface 110 may also have a plurality of troughs 150 oriented in the lateral direction 14. The troughs 150 preferably do not extend upward far enough to contact the top surface 108 of the lightweight seat member 72. The troughs 150 serve to increase the section modulus of the lightweight seat member 72 by providing transversely-oriented, or substantially vertically-oriented sections of material that do not bend easily about the longitudinal axis 12. Thus, the lightweight seat member 72 resists bending in a way that would tend to raise or lower the first and second sides 100, 102 of the lightweight seat member 72 with respect to the remainder of the lightweight seat member 72. The troughs 150 may also provide handholds for a user so that the chair 10 can easily be folded, unfolded, and carried by a user.

In embodiments in which the lightweight seat member 72 is hollow, as with a blow-molded lightweight seat member 72, kiss-throughs 152 may be formed within the troughs 150 to connect the top and bottom surfaces 108, 110 of the lightweight seat member 72. The kiss-throughs 152 keep the top surface 108 from being pressed into the hollow interior of the lightweight seat member 72 under a user's weight. However, the kiss-throughs 152 may be positioned around the center of the lightweight seat member 72 to permit slight deformation so that the lightweight seat member 72 has a somewhat soft feel. Styling lines 154 may also be provided in the bottom surface 110 of the lightweight seat member 72 to add aesthetic to the chair 10 in the folded configuration. An injection hole 156 may remain in the bottom surface 110 where a nozzle was inserted into a mold to inject air.

The kiss-throughs 152 and the troughs 150, as depicted in FIG. 3, have been arranged to increase the structural rigidity and overall strength of the lightweight seat member 72. Although other configurations may be used, the embodiment depicted in FIG. 3 is presently preferred because it provides good support while adding a minimum of material to the seat 72. Consequently, the overall weight of the folding chair 10 is kept at a minimum.

Figure 4:
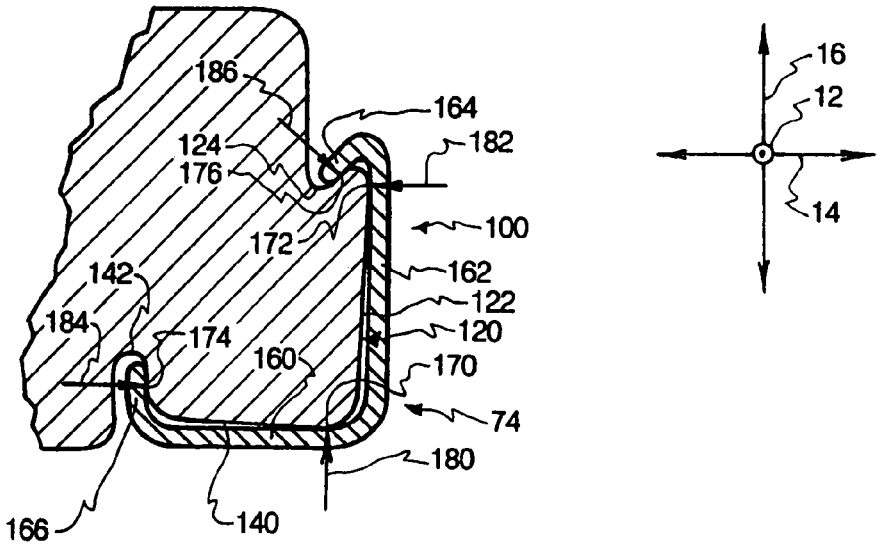
FIG. 4 is a cutaway, sectioned view of part of the lightweight seat member and one of the support brackets of FIG. 1, depicting one possible manner in which the support bracket may engage the lightweight seat member.

Referring to FIG. 4, a sectioned view of a portion of the seat 18, including the first side 100 of the lightweight seat member 72 and the first support bracket 74, is depicted, taken from behind the seat 18. The support brackets 74, 76 preferably have a cross-sectional shape configured to interlock with the lightweight seat member 72 to restrict motion parallel to the cross-section (in the lateral or transverse directions 14, 16). More specifically, the support brackets 74, 76 preferably have an enclosing cross-sectional shape. An "enclosing" cross sectional shape is a shape in which an opening of the cross section is narrower than the widest expanse of a structure, parallel to the opening, that can be contained within the cross section. An enclosing structure with a shape conforming generally to the enclosing shape is therefore unable to escape through the opening.

Although the enclosing shape is one preferred method of obtaining interlocking between the support brackets 74, 76 and the lightweight seat member 72, the support brackets 74, 76 need not have an enclosing shape to engage the lightweight seat member 72 in interlocking fashion. The support brackets 74, 76 may, for example, have outwardly extending edges (not shown) engaged within corresponding slots or grooves of the lightweight seat member 72.

As shown in FIG. 4, the first bracket 74 preferably takes the form of an L-shaped member with lips extending toward the interior of the L to form an enclosing shape. More specifically, the first support bracket 74 may have a supporting flange 160 positioned underneath the transverse engagement surface 140 of the lightweight seat member 72. The supporting flange 160 may simply comprise a comparatively flat piece of material perpendicular to the transverse direction 16, extending along the length of the lightweight seat member 72 in the longitudinal direction 12. An attachment flange 162 may extend in a substantially transverse direction from the supporting flange 160 to cover the lateral engagement surface 122 of the lateral ridge 120, and may also extend along the length of the lightweight seat member 72 in the longitudinal direction 12. Thus, the attachment flange 162 is preferably substantially perpendicular (at a near 90° angle) to the support flange 160.

Furthermore, an upper lip 164 may extend inward from the attachment flange 162 and into the engagement groove 124. The upper lip 164 may advantageously form an acute angle with respect to the attachment flange 162 so that the attachment flange 162 extends both inward and downward to grip the edges of the engagement groove 124. The upper lip 164 may, for example, be positioned at a 40° to 60° angle with respect to the attachment flange 162. An angle of 50° may be preferred. A lower lip 166 may extend upward, substantially perpendicular to the supporting flange 160 to engage the slot 142.

Between the lips 164, 166 of the cross-section, an opening exists in the cross-sectional shape of the first support bracket 74. Since the lips 164, 166 are directed generally inward, the opening is not large enough to permit the first support bracket 74 to slip out of engagement with the lightweight seat member 72 in the lateral or transverse directions 14, 16. Consequently, the cross-sectional shape of the first support bracket 74, as embodied in FIG. 4, is enclosing.

Although the L-shape depicted in FIG. 4 is preferred, the cross-section of the support brackets 74, 76 may have any other suitable enclosing or partially-enclosing shape, such as a C-shape. Alternatively, the support brackets 74, 76 need not have an enclosing shape, and the sides 100, 102 of the lightweight seat member 72 may instead each have an enclosing shape configured to hold the support brackets 74, 76 in place. The configuration of FIG. 4 may, however, have significant manufacturing benefits over these alternatives.

The enclosing cross-sectional shape shown in FIG. 4 provides counterbalancing forces in both the lateral direction 14 and the transverse direction 16 to prevent relative motion between the first support bracket 74 and the lightweight seat member 72 in those directions. The supporting flange 160, the attachment flange 162, the upper lip 164, and the lower lip 166 need not contact the lightweight seat member 72 uniformly across an entire surface to provide those counterbalancing forces. If desired, the lightweight seat member 72 may instead contact each of the flanges 160, 162 and the lips 164, 166 at a contact point extending in the longitudinal direction 12 along the length of the first support bracket 74.

For example, the supporting flange 160 may contact the bottom surface 110 of the lightweight seat member 72 at a first contact point 170. The attachment flange 162 may contact the lateral engagement surface 122 at a second contact point 172. Similarly, the second lip 166 may contact the slot 142 at a third contact point 174, and the first lip 164 may contact the engagement groove 124 at a fourth contact point 176. At each of the contact points 170, 172, 174, 176, the first support bracket 74 may exert a force against the lightweight seat member 72 perpendicular to the surface of the first support bracket 74 at which the contact point 170, 172, 174, 176 exists.

Thus, a first restraining force 180 may be applied by the supporting flange 160 at the first contact point 170, in an upward direction, perpendicular to the supporting flange 160. The second, third, and fourth contact points 172, 174, 176 may each have an associated restraining force 182, 184, 186 perpendicular to the attachment flange 162, the lower lip 166, and the upper lip 164, respectively.

The second restraining force 182 acts inward along the lateral axis 14, and the third restraining force 184 acts outward along the lateral axis 14 to oppose the second restraining force 182. The fourth restraining force 186 also has a component lying along the lateral axis 14 that resists the second restraining force 182. Similarly, the first restraining force 180 is pressed upward along the transverse axis 16, and the fourth restraining force 186 has a component along the transverse axis 16 that presses downward to oppose the first restraining force 180. The restraining forces 180, 182, 184, 186 act to keep the first support bracket 74 and the lightweight seat member 72 in static equilibrium with respect to the lateral and transverse directions 14, 16. Thus, relative motion between the first support bracket 74 and the lightweight seat member 72 in any direction within the plane formed by the lateral and transverse directions 14, 16 is restricted.

The restraining forces 180, 182, 184, 186 also restrain relative motion between the first support bracket 74 and the lightweight seat member 72 in the longitudinal direction 12. When two objects are in contact with one another, static friction tends to keep them from moving relative to each other in a direction parallel to the surfaces at which contact exists. Static friction is generally proportional to the normal force, or force pressing the objects together, and the frictional coefficient, which is related to the size and roughness of the contacting surfaces. The restraining forces 180, 182, 184, 186 therefore produce a frictional force acting to resist relative motion in the longitudinal direction 12.

Preferably, the frictional force is large enough to resist relative motion of the support brackets 74, 76 and the lightweight seat member 72, even if the tabs 99 are somehow disengaged from the tab engagement slots 144. However, the frictional force is preferably not so great that insertion of the lightweight seat member 72 in engagement with the brackets 74, 76 is made overly difficult. Thus, the geometries of the lightweight seat member 72 and the brackets 74, 76 are preferably designed to ensure that the restraining forces 180, 182, 184, 186 have a magnitude that will induce the appropriate level of frictional force.

The frictional force may also be modified by adjusting the contact points 170, 172, 174, 176 to create larger or smaller surface areas in contact with each other. Additionally, the frictional force may be adjusted by increasing or decreasing the surface roughness of the lateral ridge 120 and/or the support brackets 74, 76. The application of frictional force to keep the support brackets 74, 76 attached to the lightweight seat member 72 may be referred to as "engagement," or "gripping engagement." The force required to produce engagement between the support brackets 74, 76 and the lightweight seat member 72 is the "engagement force."

Typically, the "disengagement force," or force required to disengage the support brackets 74, 76 from the lightweight seat member 72 (with the tabs 99 disengaged), will be about the same as the engagement force. The disengagement force may even be somewhat greater than the engagement force because the disengagement force must overcome the static friction between the support brackets 74, 76 and the lightweight seat member 72. The static friction is typically larger than the dynamic friction that resists the engagement force.

The restraining forces 180, 182, 184, 186 enable the support brackets 74, 76 to grip the lightweight seat member 72 without the use of mechanical fasteners. "Mechanical fasteners," as used in this application, refers to rigid devices used to connect two separate members together. Thus, screws, nuts, bolts, rivets, locking pins, and the like are all mechanical fasteners. However, non-rigid attachment mechanisms, such as glues, epoxies, and the like, are not mechanical fasteners.

The first support bracket 74 would still have an enclosing shape if the upper lip 164 were perpendicular to the attachment flange 162. However, the acute angle of the upper lip 164, as depicted, may provide a more lasting engagement between the first support bracket 74 and the lightweight seat member 72.

More specifically, with brief reference to FIG. 1, a user sitting toward the front surface of the lightweight seat member 72 of the folding chair 10 may induce a bending moment in the seat 18 that must be resisted by the rivet 66 connecting the first support bracket 74 to the first rear leg 24. Thus, the rivet 66 may pull downward on the rear end 78 of the first support bracket 74 to resist the downward force of the user against the forward part of the seat 18. The rear end 78 of the first support bracket 74, in return, pulls downward against the lateral ridge 120 of the lightweight seat member 72. As a result, the upper lip 164 is pressed into the engagement groove 124. This pressure tends to resist inward pivoting of the walls of the engagement groove 124 that may result in bending of the lightweight seat member 72 under a user's weight.

If the angle between the upper lip 164 and the attachment flange 162 were formed or bent into an obtuse configuration, the pressure between the upper lip 164 and the sides of the engagement groove 124 would tend to bend the upper lip 164 further, bend the attachment flange 162 outward, and/or deform the lateral ridge 120 inward. As a result, the upper lip 164 maybe moved sufficiently in the lateral direction 14 with respect to the engagement groove 124 to disengage the upper lip 164 from the engagement groove 124. The probable result of such disengagement would be failure of the folding chair 10 due to complete disengagement of the lightweight seat member 72 from the first support bracket 74, extreme deformation of the lightweight seat member 74, or the like.

As a result of the acute angle, pressure of the sides of the engagement groove 124 upward against the upper lip 164 is directed toward the point at which the upper lip 164 meets the attachment flange 162. Thus, the moment arm tending to bend the upper lip 164 upward is reduced, and the upper lip 164 is drawn inward into tighter engagement with the engagement groove 124. Consequently, with the acute angle, the weight of a user on the seat 18 tends to simply tighten the engagement of the upper lip 162 of the rear end 78 of the first support bracket 74 within the engagement groove 124.

Preferably, each of the support brackets 72, 74 comprises an arcuate shape in the longitudinal direction 12, as shown in FIGS. 1 and 2. An "arcuate" shape refers to a member formed into an overall curve with a substantially constant radius along the entire length of the member. Preferably, the lateral ridge 120 has an arcuate shape with a radius substantially equal to that of the first support bracket 74. The arcuate shape is beneficial because it discourages bending of the support brackets 74, 76 without adding a great deal of material.

In effect, the arcuate shape increases the sectional modulus of the support brackets 74, 76 by displacing material from the longitudinal axis of the support brackets 74, 76. More specifically, the front and rear ends 77, 78 of the support brackets 74, 76 are raised up with respect to the intermediate portion 79. The intermediate portion 79 lies generally below the longitudinal axis of the support brackets 74, 76, while the ends 77, 78 are positioned above the longitudinal axis. Thus, the support brackets 74, 76 have a much higher sectional modulus with the arcuate shape than a straight shape would provide. Bending of the seat 18 in the longitudinal direction 12, or from front-to-back, is therefore resisted.

The support brackets 74, 76 may be easily manufactured through a number of different process including extrusion, stamping, casting, and the like. According to a preferred method, a large, circular piece of metal is first punched out and separated into arcuate sections in a die, such as a 14 station die. Each arcuate section may then be bent to form the L-shape depicted in FIG. 14, and bent again to form each of the lips 164, 166. Bending may be performed against a circular edge so that the arcuate shape of each section is preserved.

With reference again to FIG. 2, the folding chair 10 may be assembled comparatively easily, with a minimum of manual labor. According to one presently preferred method of assembly, the first and second leg assemblies 30, 32 are first assembled. Thus, the first front leg 20 and the first rear leg 24 may each be pivotally connected to the first link 60 with the rivets 64, and pivotally connected to the first support bracket 74 with the rivets 66 to form the first leg assembly 30. The second leg assembly 32 may be similarly created by pivotally connecting the second front leg 22 and the second rear leg 26 to the second link 62 with the rivets 64, and to the second support bracket 76 with the rivets 66.

Once the leg assemblies 30, 32 have been assembled, the front and rear struts 50, 52 may be affixed within the alcoves 97 to attach the leg assemblies 30, 32 together. The backrest 28 may then be inserted between the upper ends 42 of the front legs 20, 22 by bending the upper ends 42 outward slightly in the lateral direction 14, if necessary. The backrest 28 may be fixed in place between the upper ends by inserting the studs 128 into the keyholes 130, and then pressing the backrest 28 downward so that the studs 128 are engaged within the slots of the keyholes 130.

If desired, the lightweight seat member 72 maybe installed last. The support brackets 74, 76 maybe rotated into a suitable position to receive the lightweight seat member 72, and then the lightweight seat member 72 may be aligned with the support brackets 74, 76 so that the lateral ridge 120 is positioned to enter the front end 77 of the first support bracket 74. Pressure may then be applied against the lightweight seat member 72 by, for example, pressing against the front surface 104 to slide the lightweight seat member 72 into engagement with the support brackets 74, 76. The pressure may be applied continuously until the front end 77 of the brackets 74, 76 abuts the abutment 126 on the first and second sides 100, 102 of the lightweight seat member 72.

Pressure may be applied against the lightweight seat member 72 by hand, or by using a machine. For example, a simple press (not shown) may be configured to exert pressure against the front surface 104 or grip the lightweight seat member 72 for insertion into the support brackets 74, 76. As long as the support brackets 74, 76 and the lightweight seat member 72 are consistently manufactured from one chair to the next, the press may be configured to provide a preset pressure against the lightweight seat member 72. This pressure may, for example, range from about 10 pounds to about 1,000 pounds. Preferably, the pressure is relatively low, such as 50 pounds, so that the probability of damaging any part of the folding chair 10 through malfunction of the press or improper dimensioning or alignment of the lightweight seat member 72 or support brackets 74, 76 is low. The pressure may be applied continuously, and may be varied to move the lightweight seat member 72 in an arcuate path corresponding to its longitudinal shape.

After the abutments 126 of the lightweight seat member 72 are seated against the front ends 77 of the support brackets 74, 76, pressure need no longer be applied. Since the tabs 99 are aligned with the tab engagement slots 144, they will snap into engagement with the tab engagement slots 144 as they return to their preformed, bent position. In the alternative, if the tabs 99 were formed parallel to the supporting flange 160, the tabs 99 may be folded into position within the tab engagement slots 144. The tabs 99 may not be necessary to keep the lightweight seat member 72 securely engaged within the support brackets 74, 76, but may be used in any case to provide an added measure of safety under abnormal usage conditions.

Such a method of assembly alleviates problems present in the prior art. There are no supporting structures extending from one side of the lightweight seat member 72 to the other. For example, instead of long front and tear thru-rods, separate rivets 64, 66 for each side are used to connect the leg assemblies 30, 32 to the seat 18. This permits assembly of the folding chair 10 without the problem of aligning the leg assemblies 30, 32 with the single rod. In addition, the absence of any horizontal rods extending through the hollow interior of the lightweight seat member 72 is beneficial because supporting structures, such as the troughs 150 and kiss-throughs 152 shown in FIG. 3, may be formed directly in the material of the lightweight seat member 72 without interference from foreign structures inside the lightweight seat member 72. The absence of any type of metal plate spanning the width of the lightweight seat member 72 serves to decrease the weight of the folding chair 10.

Additionally, the interference fit configuration of the present invention is beneficial because the lightweight seat member 72 is securely supported in a way that distributes stresses comparatively evenly to avoid creating failure points. The unique shape of the support brackets 74, 76 also supports the lightweight seat member 72 against bending with the addition of a minimal amount of heavier material so that the overall weight of the folding chair 10 is kept to a minimum. Thus, the folding chair 10 of the present invention is generally inexpensive, easy to manufacture, lightweight, easy to use, and comfortable.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

What is claimed is:

1. A folding chair that is capable of being moved between a first position for supporting a person and a second position for storage, the folding chair comprising:

a first leg assembly including a first leg and a second leg;

a first link at least partially interconnecting the first leg and the second leg of the first leg assembly, the first link being sized and configured to allow the chair to be moved between the first position and the second position;

a second leg assembly including a first leg and a second leg;

a second link at least partially interconnecting the first leg and the second leg of the second leg assembly, the second link being sized and configured to allow the chair to be moved between the first position and the second position;

a seat constructed from plastic and being at least partially disposed between the first leg assembly and the second leg assembly, the seat comprising:

a first section disposed proximate the first leg assembly, the first section including a first portion and a second portion; and a second section disposed proximate the second leg assembly, the second section including a first portion and a second portion;

a first support bracket connected to the first leg and the second leg of the first leg assembly, the first support bracket including a first portion and a second portion; and a second support bracket connected to the first leg and the second leg of the second leg assembly, the second support bracket including a first portion and a second portion;

wherein at least a portion of the first support bracket, the first leg of the first leg assembly, the first link and the second leg of the first leg assembly are pivotally connected as part of a four-pivot linkage to permit the chair to be moved between the first position and the second position; and wherein at least a portion of the second support bracket, the first leg of the second leg assembly, the second link and the second leg of the second leg assembly are pivotally connected as part of a four-pivot linkage to permit the chair to be moved between the first position and the second position.

2. The folding chair as in claim 1, further comprising one or more engaging portions between the first portion of the first section of the seat and the first portion of the first support bracket; further comprising one or more engaging portions between the second portion of the first section of the seat and the second portion of the first support bracket; further comprising one or more engaging portions between the first portion of the second section of the seat and the first portion of the second support bracket; and further comprising one or more engaging portions between the second portion of the second section of the seat and the second portion of the second support bracket.

3. The folding chair as in claim 1, wherein at least a portion of the first portion of the first section of the seat contacts at least a portion the first portion of the first support bracket to help restrict relative motion between the seat and the first support bracket; wherein at least a portion of the second portion of the first section of the seat contacts at least a portion of the second portion of the first support bracket to help restrict relative motion between the seat and the first support bracket; wherein at least a portion of the first portion of the second section of the seat contacts at least a portion of the first portion of the second support bracket to help restrict relative motion between the seat and the second support bracket; and wherein at least a portion of the second portion of the second section of the seat contacts at least a portion of the second portion of the second support bracket to help restrict relative motion between the seat and the support bracket.

4. The folding chair as in claim 1, further comprising a first projection extending from the first portion of the first support bracket and a second projection extending from the second portion of the first support bracket; and further comprising a first receiving portion in the seat that is sized and configured to receive the first projection extending from the first portion of the first support bracket and a second receiving portion in the seat that is sized and configured to receive the second projection extending from the second portion of the first support bracket; further comprising a first projection extending from the first portion of the second support bracket and a second projection extending from the second portion of the second support bracket; and further comprising a first receiving portion in the seat that is sized and configured to receive the first projection extending from the first portion of the second support bracket and a second receiving portion in the seat that is sized and configured to receive the second projection extending from the second portion of the second support bracket.

5. The folding chair as in claim 1, wherein the seat is constructed from blow-molded plastic and includes a hollow interior chamber that is formed during the blow-molding process.

6. The folding chair as in claim 1, wherein no mechanical fasteners are required to connect the seat to the first support bracket and to the second support bracket.

7. The folding chair as in claim 1, wherein the first leg assembly and the second leg assembly are constructed from metal; and wherein the first leg assembly and the second leg assembly have a generally elliptical cross-section.

8. The folding chair as in claim 1, further comprising a first tab that extends from the first support bracket and a second tab that extends from the second support bracket; and further comprising a first tab receiving portion in the seat and a second tab receiving portion in the seat; wherein the first tab is sized and configured to be inserted into the first tab receiving portion and the second tab is sized and configured to be inserted into the second tab receiving portion to help prevent unintended removal of the seat from the first support bracket and the second support bracket.

9. The folding chair as in claim 1, wherein at least a portion of the first support bracket at least partially encloses a portion of the seat to facilitate attachment of the first support bracket to the seat; and wherein at least a portion of the second support bracket at least partially encloses a portion of the seat to facilitate attachment of the second support bracket to the seat.

10. A folding chair that is capable of being moved between a first position for supporting a person and a second position for storage, the folding chair comprising:

a first leg assembly including a first leg and a second leg;

a first link at least partially interconnecting the first leg and the second leg of the first leg assembly, the first link being sized and configured to allow the chair to be moved between the first position and the second position;

a second leg assembly including a first leg and a second leg;

a second link at least partially interconnecting the first leg and the second leg of the second leg assembly, the second link being sized and configured to allow the chair to be moved between the first position and the second position;

a seat constructed from blow-molded plastic and including a hollow interior portion that is formed during the blow-molding process, the seat including a first section disposed proximate the first leg assembly and a second section disposed proximate the second leg assembly;

a first support bracket connected to the first leg and the second leg of the first leg assembly, the first support bracket including a first portion with an inwardly extending projection and a second portion with an inwardly extending projection, at least a portion of the first portion of the first support bracket being sized and configured to abut at least a portion of the first section of the seat and the inwardly extending projection of the first portion of the first support bracket being sized and configured to be inserted into a receiving portion in the seat, at least a portion of the second portion of the first support bracket being sized and configured to abut at least a portion of the first section of the seat and the inwardly extending projection of the second portion of the first support bracket being sized and configured to be inserted into a receiving portion in the seat; and a second support bracket connected to the first leg and the second leg of the second leg assembly, the second support bracket including a first portion with an inwardly extending projection and a second portion with an inwardly extending projection, at least a portion of the first portion of the second support bracket being sized and configured to abut at least a portion of the second section of the seat and the inwardly extending projection of the first portion of the second support bracket being sized and configured to be inserted into a receiving portion in the seat, at least a portion of the second portion of the second support bracket being sized and configured to abut at least a portion of the second section of the seat and the inwardly extending projection of the second portion of the second support bracket being sized and configured to be inserted into a receiving portion in the seat.

11. The folding chair as in claim 10, wherein no mechanical fasteners are required to connect the seat to the first support bracket and to the second support bracket.

12. The folding chair as in claim 10, wherein the first leg assembly and the second leg assembly are constructed from metal; and wherein the first leg assembly and the second leg assembly have a generally elliptical cross-section.

13. The folding chair as in claim 10, further comprising a first tab that extends generally inward from the first support bracket and a second tab that extends generally inward from the second support bracket; and further comprising a first tab receiving portion in the seat and a second tab receiving portion in the seat; wherein the first tab is sized and configured to be inserted into, the first tab receiving portion and the second tab is sized and configured to be inserted into the second tab receiving portion to prevent the unintended removal of the seat from the first support bracket and the second support bracket.

14. The folding chair as in claim 10, wherein at least a portion of the first support bracket at least partially encloses a portion of the seat to facilitate attachment of the first support bracket to the seat; and wherein at least a portion of the second support bracket at least partially encloses a portion of the seat to facilitate attachment of the second support bracket to the seat.

15. A folding chair that is capable of being moved between a first position for supporting a person and a second position for storage, the chair comprising:

a first front leg and a second front leg;

a first rear leg and a second rear leg;

a first link at least partially interconnecting the first front leg and the first rear leg;

a second link at least partially interconnecting the second front leg and the second rear leg;

a first bracket including a first attachment portion and a second attachment portion, the first bracket at least partially interconnecting the first front leg and the first rear leg, at least a portion of the first front leg, the first rear leg, the first link and the first bracket form at least a portion of a four-bar, four-pivot linkage;

a second bracket including a first attachment portion and a second attachment portion, the second bracket at least partially interconnecting the second front leg and the second rear leg, at least a portion of the second front leg, the second rear leg, the second link and the second bracket form at least a portion of a four-bar, four-pivot linkage; and a seat constructed from blow-molded plastic and including a generally hollow interior portion formed during the blow-molding process, the seat including a first section with a first attachment portion and a second attachment portion, and a second section with a first attachment portion and a second attachment portion;

wherein the first attachment portion and the second attachment portion of the first bracket are sized and configured to engage at least a portion of the first attachment portion and the second attachment portion of the first section of the seat; and wherein the first attachment portion and the second attachment portion of the second bracket are sized and configured to engage at least a portion of the first attachment portion and the second attachment portion of the second section of the seat.

16. The folding chair as in claim 15, wherein no mechanical fasteners are required to connect the seat to the first bracket or to the second bracket.

17. The folding chair as in claim 16, further comprising a first projection extending from the first attachment portion of the first bracket and a second projection extending from the second attachment portion of the first bracket; and further comprising a first receiving portion in the seat that is sized and configured to receive the first projection extending from the first attachment portion of the first bracket and a second receiving portion in the seat that is sized and configured to receive the second projection extending from the second attachment portion of the first bracket; further comprising a first projection extending from the first attachment portion of the second bracket and a second projection extending from the second attachment portion of the second bracket; and further comprising a first receiving portion in the seat that is sized and configured to receive the first projection extending from the first attachment portion of the second bracket and a second receiving portion in the seat that is sized and configured to receive the second projection extending from the second attachment portion of the second bracket.

18. The folding chair as in claim 15, wherein the first front leg, the second front leg, the first rear leg and the second rear leg are constructed from metal; and wherein the first front leg, the second front leg, the first rear leg and the second rear leg have a generally elliptical cross-section.

19. The folding chair as in claim 15, further comprising a first tab that extends generally inward from the first bracket and a second tab that extends generally inward from the second bracket; and further comprising a first tab receiving portion in the seat and a second tab receiving portion in the seat; wherein the first tab is sized and configured to be inserted into the first tab receiving portion and the second tab is sized and configured to be inserted into the second tab receiving portion to prevent the unintended removal of the seat from the first bracket and the second bracket.

20. The folding chair as in claim 15, wherein at least a portion of the first bracket at least partially encloses a portion of the seat to facilitate attachment of the first bracket to the seat; and wherein at least a portion of the second bracket at least partially encloses a portion of the seat to facilitate attachment of the second bracket to the seat.

* * * * *

UNITED STATES PATENT AND TRADEMARK OFFICE

CERTIFICATE OF CORRECTION

PATENT NO. : 7,014,261 B2
APPLICATION NO. : 11/030427
DATED : March 21, 2006
INVENTOR(S) : Thayne B. Haney It is certified that error appears in the above-identified patent and that said Letters Patent is hereby corrected as shown below:

Column 3
Line 13, change “maybe” to --may be--

Column 5
Line 37, before “relatively” change “are” to --a--
Line 56, change “12” to --18--

Column 11
Line 57, change “maybe” to --may be--

Column 12
Line 6, change “162” to --164--
Line 37, change “FIG. 14” to --FIG. 4--
Line 63, change “maybe” to --may be--
Line 64, change “maybe” to --may be--

Column 17
Line 1, after “inserted into” remove [,]

Signed and Sealed this

Eighth Day of August, 2006

JON W. DUDAS
*Director of the United States Patent and Trademark Office*